US007510096B2

(12) United States Patent
Wang

(10) Patent No.: US 7,510,096 B2
(45) Date of Patent: Mar. 31, 2009

(54) MULTI-LAYERED CONTAINER WITH INTERMEDIATE LID

(75) Inventor: Soo Chang Wang, Seoul (KR)

(73) Assignee: Korea Alphaline Co., Ltd., Seoul (KR)

( * ) Notice: Subject to any disclaimer, the term of this patent is extended or adjusted under 35 U.S.C. 154(b) by 483 days.

(21) Appl. No.: 10/552,695

(22) PCT Filed: Apr. 7, 2004

(86) PCT No.: PCT/KR2004/000798

§ 371 (c)(1),
(2), (4) Date: Oct. 6, 2005

(87) PCT Pub. No.: WO2004/089774

PCT Pub. Date: Oct. 21, 2004

(65) Prior Publication Data

US 2006/0278552 A1 Dec. 14, 2006

(30) Foreign Application Priority Data

Apr. 9, 2003 (KR) ..... 20-2003-0010907 U
Dec. 16, 2003 (KR) ..... 20-2003-0039227 U

(51) Int. Cl.
*B65D 6/28* (2006.01)

(52) U.S. Cl. ..... 220/4.26; 220/4.27; 220/781; 220/380; 220/23.83; 206/508

(58) Field of Classification Search ..... 220/554, 220/4.26, 4.27, 781, 380, 23.6, 406, 23.83; 206/508
See application file for complete search history.

(56) References Cited

U.S. PATENT DOCUMENTS 621,601 A * 3/1899 Conley ..... 220/4.26
3,091,361 A * 5/1963 Gawron ..... 206/508
3,273,739 A * 9/1966 Wei ..... 220/4.27
3,369,691 A * 2/1968 Wei ..... 220/4.27
3,376,046 A * 4/1968 Kivett et al. ..... 280/33.998
3,811,559 A * 5/1974 Carter ..... 206/545
3,954,178 A * 5/1976 Mason, Jr. ..... 206/508
4,091,953 A * 5/1978 Daenen ..... 220/23.86
4,256,240 A * 3/1981 Woinarski ..... 220/782
4,474,303 A * 10/1984 Maccise ..... 220/4.27
4,760,921 A * 8/1988 Licari ..... 206/504
4,844,263 A * 7/1989 Hadtke ..... 206/508

(Continued)

*Primary Examiner*—Anthony D Stashick
*Assistant Examiner*—Christopher B McKinley
(74) *Attorney, Agent, or Firm*—W. Norman Roth

(57) ABSTRACT

The present invention provides a multi-layered container, including a cover (10), with a plurality of first locking projections (15), and a plurality of container bodies (20) having a plurality of locking flaps (23). Each of the plurality of locking flaps (23) rotatably extends from each of predetermined portions of the circumferential outer surface of the container body (20), with a locking hole (24) provided on the locking flap (23). The multi-layered container further includes an intermediate lid (30) provided between the cover (10) and an uppermost container body (20) or between the container bodies (20). The intermediate lid (30) has a plate-shaped part (31), a coupling part (32) bent into a channel-shape while extending from an edge of the plate-shaped part (31), and a plurality of coupling flanges (35) extending downward from predetermined portions of the coupling part (32), with a second locking projection (25) provided on an end of each of the plurality of coupling flanges (35).

5 Claims, 9 Drawing Sheets

U.S. PATENT DOCUMENTS 4,978,023 A * 12/1990 Behlmann et al. ..... 220/23.6
5,409,126 A * 4/1995 DeMars ..... 220/4.27
5,692,617 A * 12/1997 Adams ..... 206/508
5,699,925 A * 12/1997 Petruzzi ..... 220/4.27
5,709,314 A * 1/1998 Petry ..... 220/802
6,250,490 B1 * 6/2001 Loftus ..... 220/23.4
6,874,634 B2 * 4/2005 Riley ..... 206/439
2001/0038011 A1 * 11/2001 Hillis ..... 220/6
2001/0047994 A1 * 12/2001 von Holdt, Jr. ..... 220/276

* cited by examiner

MULTI-LAYERED CONTAINER WITH INTERMEDIATE LID

TECHNICAL FIELD

The present invention relates, in general, to multi-layered containers with intermediate lids and, more particularly, to a multi-layered container with an intermediate lid, which has a structure possible to sanitarily contain foods therein, and in which even existing container bodies can be stacked by using the intermediate lid.

BACKGROUND ART

Generally, container bodies to contain therein foods are made of materials, such as synthetic resin, heat resistant glass, heat resistant ceramic material and etc. Particularly, container products made of synthetic resin are easily adapted for mass production to reduce production costs thereof, and can be easily handled. Thus, the container products made of synthetic resin have been widely used.

The conventional containers include locking units which are provided on each of both the container bodies and covers to stably preserve and store therein foods and to prevent the foods from undesirably leaking out.

In the conventional containers, the container bodies each include a plurality of locking projections which are projected outward from predetermined portions around a circumferential outer surface of each of the container bodies at predetermined intervals. The cover of the containers includes a plurality of locking flaps which are provided to be vertically rotated around a film hinge. Each of the plurality of locking flaps has a coupling hole to lock each of the locking flaps to each of the locking projections.

To couple the cover to a container body, the cover is placed on an open top of the container body. In the above state, the plurality of locking flaps of the cover are rotated and pressed toward the container body, so that each of the locking flaps is elastically hooked to each of the locking projections of the container body while each of the locking projections is inserted into the coupling hole of each of the locking flaps.

However, the above-mentioned conventional containers have several problems as follows.

First, the conventional container is problematic in that it is impossible to stack. Recently, according to the trend of people eating fewer meals at home, and the trend of toward smaller families, when foods are prepared or cooked at home, most people do not cook a lot of food at a time. However, there are frequent occasions when a variety of foods are cooked a little at a time. As such, when various kinds of foods are required to be contained in a container, it is better to use a plurality of container bodies than to increase the size of one container body. However, the plurality of container bodies occupy a lot of space in a refrigerator. To solve the above problems, a multi-layered container, in which a plurality of container bodies are stacked while using one cover, is required.

However, in case that the plurality of container bodies are stacked, an outer surface of a bottom of each of the container bodies may be smeared with foods which are contained in a lower-layered container body. Furthermore, when one of the container bodies, smeared with foods on the outer surface of the bottom thereof, is put down on a surface on which dust is deposited, the dust may adhere to the outer surface of the bottom of the container body. Thereafter, when the container body smeared with the dust is again layered on another container body, the dust may fall onto foods which are contained in the another container body.

To prevent the above-mentioned unhealthful situation, a means for preventing the foods from being smeared on an upper-layered container body must be proposed.

In the meantime, to provide the conventional multi-layered container, new container bodies must be specifically designed and produced. Therefore, existing container bodies cannot be used in the conventional multi-layered containers. To overcome the above-mentioned problems, a new means must be developed to allow for use of existing container bodies in the conventional multi-layered container, thus reducing household expenses.

DISCLOSURE OF THE INVENTION

Accordingly, the present invention has been made keeping in mind the above problems occurring in the prior art, and an object of the present invention is to provide a multi-layered container with an intermediate lid, which has a structure making it possible to stack a plurality of container bodies, to sanitarily contain foods therein, and to recycle existing container bodies.

Another object of the present invention is to provide a multi-layered container with an intermediate lid, which increases coupling and contact forces between the intermediate lid and a container body and between the intermediate lid and a neighboring container body, thus preventing the contained foods from being undesirably leaked.

In an aspect, the present invention provides a multi-layered container, including: a cover, with a plurality of first locking projections provided around a circumferential outer surface of the cover at predetermined intervals to be projected outward from the outer surface of the cover; and a plurality of container bodies, having a plurality of locking flaps provided around a circumferential outer surface of each of the plurality of container bodies at predetermined intervals to correspond to the first locking projections of the cover. Each of the plurality of locking flaps rotatably extends from each of predetermined portions of the circumferential outer surface of the container body near to an open top of the container body, with a locking hole provided on the locking flap to lock the locking flap to each of the first locking projections. The multi-layered container further includes an intermediate lid provided between the cover and an uppermost container body or between the container bodies. The intermediate lid has a plate-shaped part, a coupling part bent into a channel-shape while extending from an edge of the plate-shaped part, and seated on an edge of the open top of each of the container bodies, and a plurality of coupling flanges extending downward from predetermined portions of the coupling part to be placed around the circumferential outer surface of the container body at predetermined intervals, with a second locking projection provided on an end of each of the plurality of coupling flanges to be locked to each of the locking flaps of a neighboring container body.

The multi-layered container may further include a guide rail having a pair of guide projections projected from predetermined portions of the outer surface of each of the container bodies to correspond to each of the coupling flanges of the intermediate lid, so that each of the coupling flanges slides downward along the guide rail on the outer surface of the container body while the intermediate lid is coupled to the container body.

Each of the coupling flanges may further have an inclined surface at each of both sidewalls thereof such that an inner surface of the coupling flange which is in contact with the container body is wider and an outer surface of the coupling flange is narrower, and each of the guide projections of the guide rail may be enlarged in a width as the guide projection is projected from the outer surface of the container body so that a contact surface of each of the guide projections which is in contact with each of the sidewalls of the coupling flange is inclined to correspond to the inclined surface of each of the sidewalls of the coupling flange.

The multi-layered container may further include a packing provided in the coupling part of the intermediate lid to be in close contact with the edge of the open top of the container body.

In another aspect, the present invention provides a multi-layered container, including: a cover, with a plurality of first locking projections provided around a circumferential outer surface of the cover at predetermined intervals to be projected outward from the outer surface of the cover; and a plurality of container bodies, having a plurality of locking flaps extending from each of predetermined portions of a circumferential outer surface of the container body near to an open top of each of the container bodies to correspond to each of the first locking projections. Each of the locking flaps is rotated between a position of locking the cover to the container body and a position of unlocking the cover from the container body, with a locking hole provided on the locking flap to lock the locking flap to each of the first locking projections. Each of the container bodies further has a plurality of second locking projections provided around the circumferential outer surface of each of the container bodies at predetermined intervals while being projected outward from predetermined portions near to a bottom of the container body to be parallel with the locking flaps, so that the second locking projections are locked to the locking flaps of another container body. The multi-layered container further includes an intermediate lid provided between the container bodies. The intermediate lid has a plate-shaped part, and a coupling slot part bent into a channel-shape to be opened downwardly while extending from an edge of the plate-shaped part. The coupling slot part is seated on an edge of the open top of each of the container bodies. The intermediate lid further has a third locking projection projected outward from each of predetermined portions of the coupling slot part to correspond to each of the second locking projections of each of the container bodies, so that the second and third locking projections corresponding to each other are locked to the same locking flap.

The third locking projection may further have a projection seat depressed in a circumferential direction of the intermediate lid to receive therein each of the second locking projections, and a support projection part provided on each of both ends of the projection seat to be projected to a height equal to a thickness of each of the second locking projections, thus being locked to the locking flap.

The multi-layered container may further include a packing provided in the coupling slot part of the intermediate lid to be in close contact with the edge of the open top of the container body.

BRIEF DESCRIPTION OF THE DRAWINGS

The above and other objects, features and other advantages of the present invention will be more clearly understood from the following detailed description taken in conjunction with the accompanying drawings, in which:

FIG. 9 is an enlarged perspective view of a portion around a locking flap of the multi-layered container of FIG. 7;

BEST MODE FOR CARRYING OUT THE INVENTION

Figure 1:
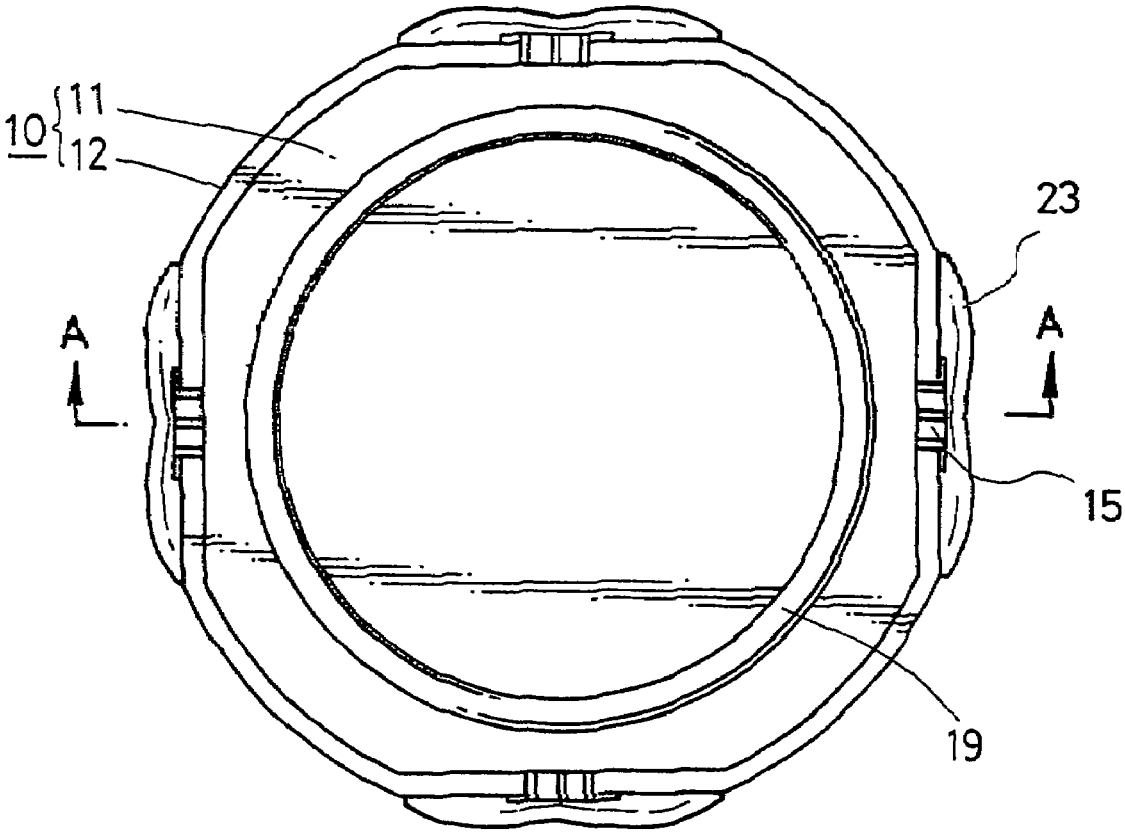
FIG. 1 is a plan view of a multi-layered container with an intermediate lid, according to an embodiment of the present invention.

Reference should now be made to the drawings, in which the same reference numerals are used throughout the different drawings to designate the same or similar components.

The present invention provides a multi-layered container with an intermediate lid, which has a structure making it possible to stack a plurality of container bodies, to sanitarily contain foods therein, and to recycle existing container bodies.

Hereinafter, a construction of the multi-layered container of the present invention will be described in detail, with reference to the attached drawings. Multi-layered containers having circular cross-sections will be explained according to following embodiments of the present invention, but the bounds of claims of the present invention are not limited to the containers having circular cross-sections.

Figure 2:
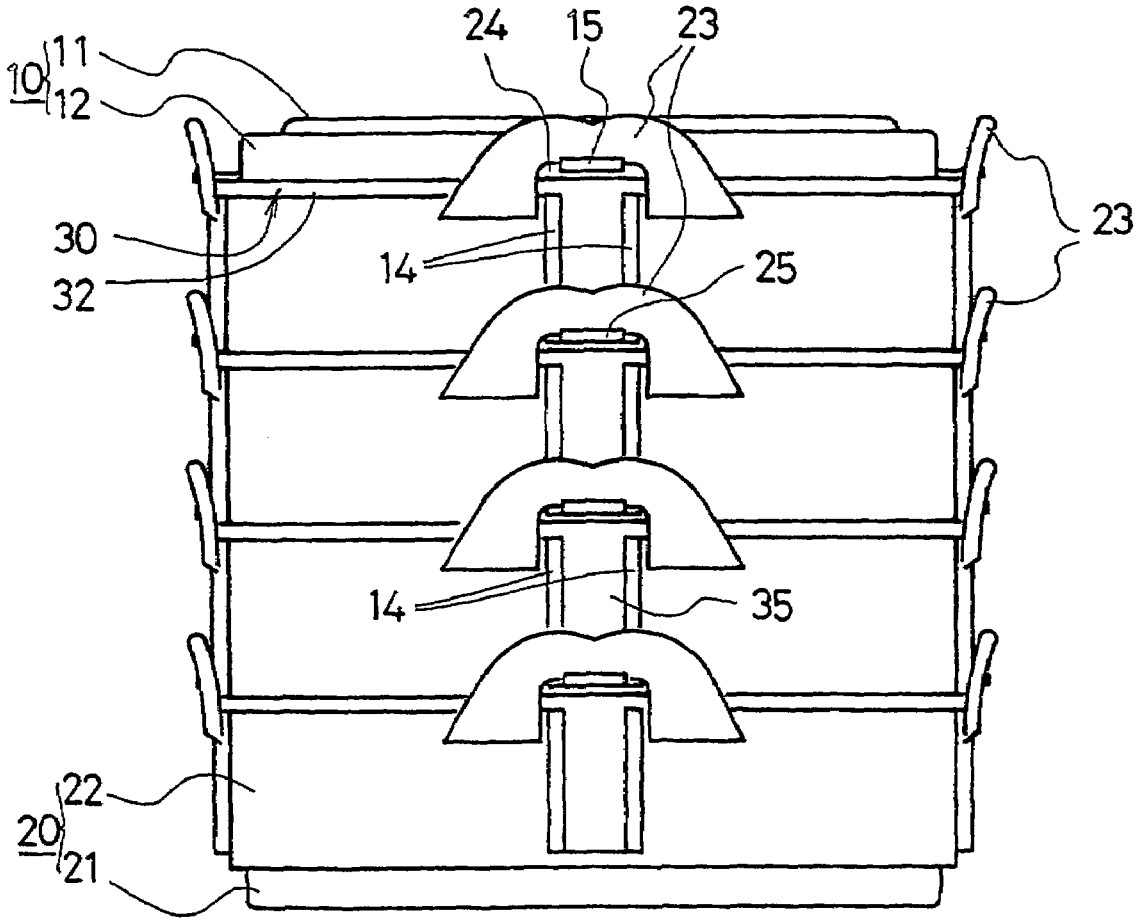
FIG. 2 is a side view of the multi-layered container of FIG. 1.

As shown in FIGS. 1 and 2, the multi-layered container according to a first embodiment of the present invention includes a cover 10, a plurality of container bodies 20 and a plurality of intermediate lids 30.

The cover 10 defines a nearly circular appearance. The cover 10 has a locking region which is provided on each of diametrically opposite parts of an outer surface of the cover 10, based on a central portion of the cover 10. Each of the locking regions of the cover 10 defines a plate-shaped appearance. In the first embodiment, the locking region is provided on each of four parts of the front, rear, left and right of the cover 10. The cover 10 includes a cover plate part 11 to cover an uppermost container body 20. The cover 10 further includes a sidewall part 12 which extends downward from the cover plate part 11, with a first locking projection 15 provided on each of the locking regions around an outer surface of the sidewall part 12 to be projected outward from the outer surface of the sidewall part 12.

Each of the first locking projections 15 has a first locking protrusion 16 which is protruded upward from an end of each of the first locking projections 15. Thus, each of a plurality of locking flaps 23 is elastically locked to and unlocked from each of the first locking projections 15 by each of the first locking protrusions 16.

In the same manner as the cover 10, each of the plurality of container bodies 20, which has a structure possible to be covered with the cover 10, includes a plurality of locking regions each having thereon a locking device. Each of the locking regions of the container body 20 defines a plate appearance. The container body 20 has a circular appearance. Each of the container bodies 20 comprises a bottom part 21 and a sidewall part 22. Each of the container bodies 20 further comprises a seating rib (not shown) which is provided around a predetermined portion of an outer surface of the sidewall part 22 near to an open top of the container body 20 to be projected outward in a circumferential direction of the sidewall part 22. Thus, the sidewall part 12 of the cover 10 is seated on the seating rib of the container body 20. A stepped part 28 is provided along a lower edge of each of the container bodies 20 by depressions of the sidewall part 22 and the bottom part 21, thus being stepped inward from the sidewall part 22. The stepped part 28 of each of the container bodies 20 is seated on an edge of an open top of another container body 20, thus allowing the container bodies 20 to be stacked on top of another.

The locking flap 23 is provided on each of the locking regions of each of the container bodies 20, so that the locking flaps 23 are locked to the first locking projections 15 of the cover 10. Each of the locking flaps 23 is projected outward from the outer surface of the sidewall part 22 of each of the container bodies 20 to be aligned with the seating rib of the container body 20. Furthermore, each of the locking flaps 23 is rotated around a film hinge which is provided on each of predetermined portions extending from the seating rib. Each of the locking flaps 23 has thereon a locking hole 24 to lock -the locking flap 23 to each of the first locking projections 15. Each of the locking holes 24 extends to the outer surface of the sidewall part 22 of the container body 20. That is, the film hinge is not provided on a predetermined portion of the locking flap 23 on which the locking hole 24 is provided, so that the locking flap 23 is smoothly rotated. Furthermore, each of the locking flaps 23, which is locked to each of the first locking projections 15 or each of second locking projections 25, which will be described later herein, is prevented from being undesirably unlocked due to elasticity of each of the film hinges.

The multi-layered container further includes a guide rail 13 which is provided on each of the locking regions of the sidewall part 22 of each of the container bodies 20 in a vertical direction of the sidewall part 22. Each of the guide rails 13 is defined by a pair of guide projections 14 which are spaced apart from each other and are provided on predetermined portions of the outer surface of the sidewall part 22 of each of the container bodies 20 in the vertical direction of the sidewall part 22 to be projected outward from the outer surface of the sidewall part 22. Each of the guide projections 14 has an inclined surface such that each of the guide projections 14 is enlarged in a width while a space between the pair of guide projections 14 is narrowed as the guide projection 14 is projected from the outer surface of the sidewall part 22 of the container body 20.

In the meantime, the cover 10 and each of the container bodies 20 have structures which make it possible to seat the container body 20 on the cover 10 which is separated from the uppermost container body 20. That is, each of the container bodies 20 has a projection ring 29 which has a predetermined width and is projected downward from an outer surface of the bottom part 21 of the container body 20 to form a support ring on the bottom part 21. The cover 10 has a seating ring 19 which has a predetermined radius to correspond to an inner diameter or an outer diameter of the projection ring 29 of the container body 20 and is projected upward from an outer surface of the cover plate part 11 of the cover 10 to form a support ring on the cover 10. To seat the container bodies 20 on the cover 10, the cover 10 is placed on a support surface. Thereafter, the container bodies 20 are sequentially seated on the cover 10 while the seating ring 19 of the cover 10 is in close contact with the projection ring 29 of a lowermost container body 20. At this time, by a correspondence between the seating ring 19 and the projection ring 29, the container bodies 20 are prevented from undesirably moved on the cover 10.

Figure 3:
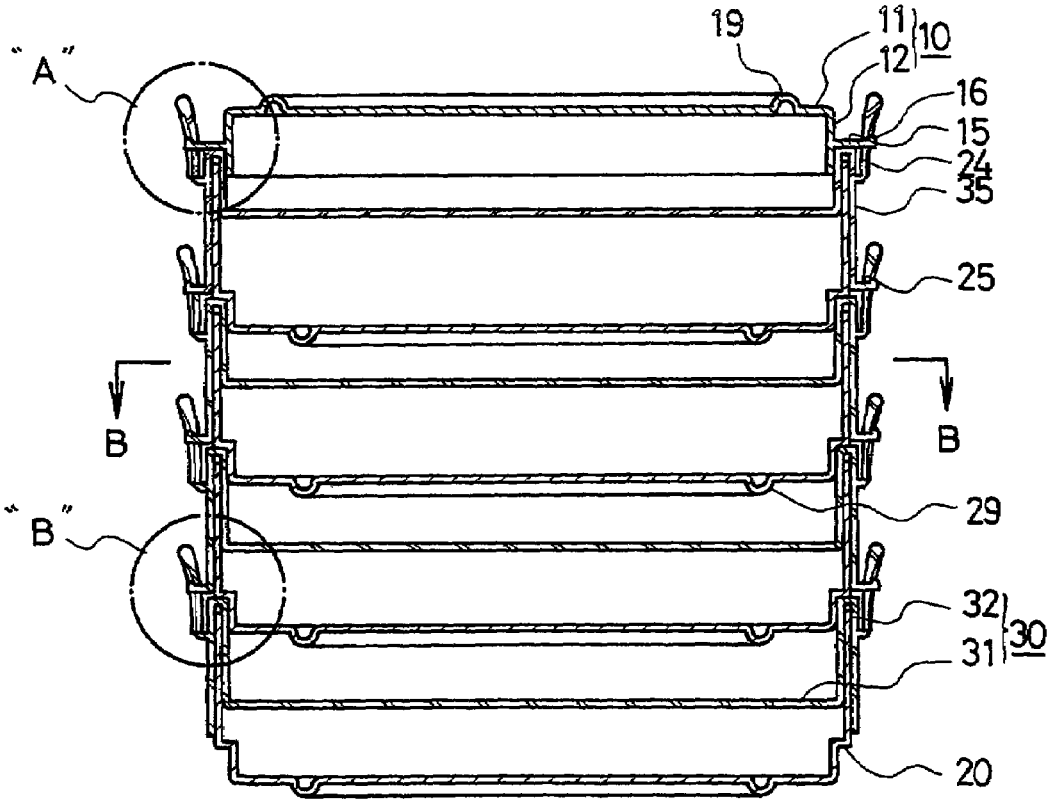
FIG. 3 is a sectional view taken along the line A-A of FIG. 1.
Figure 4:
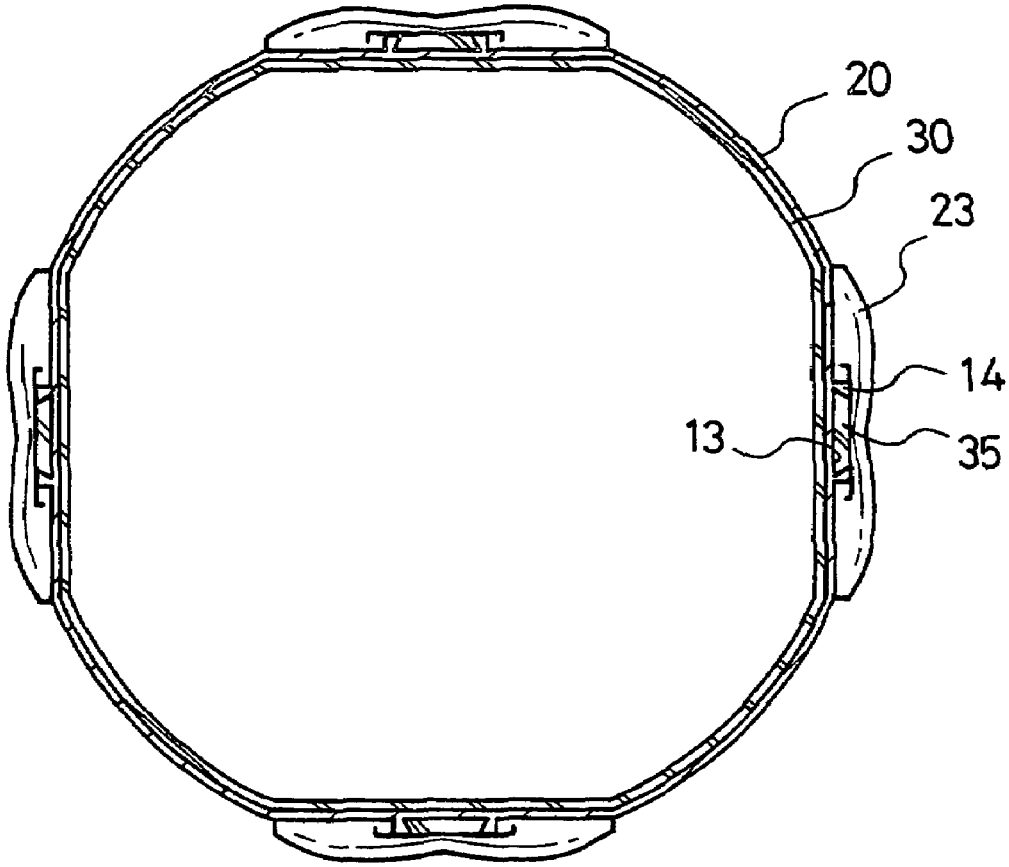
FIG. 4 is a sectional view taken along the line B-B of FIG. 3.

As shown in FIGS. 3 and 4, the multi-layered container according to the first embodiment further includes a plurality of intermediate lids 30 which are respectively provided between the cover and an uppermost container body and between the container bodies. Each of the intermediate lids 30 has a plate-shaped part 31 to prevent contact between neighboring two-layered container bodies 20, and a coupling part 32 to couple the plate-shaped part 31 to the container body 20. Each of the intermediate lids 30 further has a coupling flange 35 which extends from a predetermined portion of the coupling part 32 to an upper portion of the stepped part 28 of the container body 20.

The plate-shaped part 31 is arranged to be parallel with both the cover plate part 11 of the cover 10 and the bottom part 21 of the container body 20. The coupling part 32 is bent into a channel-shape while extending upward, outward and downward from an edge of the plate-shaped part 31. The multi-layered container further includes a packing 33 which is provided in the coupling part 32 of the intermediate lid 30. By the packing 33, a space defined between the container body 20 and the intermediate lid 30 is sealed, thus preventing contained foods from undesirably leaking out.

The coupling flange 35 comprises two pairs of coupling flanges 35 to correspond to the locking regions of the container body 20. When each of the intermediate lids 30 is coupled to each of the container bodies 20, each of the coupling flanges 35 is arranged to pass through the locking hole 24 of each of the locking flaps 23. Furthermore, each of the coupling flanges 35 of each of the intermediate lids 30 slides along each of the above-mentioned guide rails 13. Therefore, each of the coupling flanges 35 comprises an inclined surface at each of both sidewalls thereof such that an inner surface of the coupling flange 35 which is in contact with the container body 20 is wider and an outer surface of the coupling flange 35 is narrower to correspond to the shape of each of the guide rails 35. Each of the coupling flanges 35 has a second locking projection 25 which is provided on an end of the coupling flange 35 to be locked to each of the locking flaps 23 of a neighboring container body 20. Each of the second locking projections 25 has a second locking protrusion 26 which is protruded upward from an end of each of the second locking projections 25. Each of the second locking projections 25 is positioned just above the stepped part 28 of container body 20 while the intermediate lid 30 is coupled to the container body 20. In the meantime, an intermediate lid 30, which is coupled to a lowermost container body 20, may not have the second locking projections 25 because no locking flaps 23 are placed below the lowermost container body 20.

The intermediate lids 30 have different storage capacities. According to a height of a part of the coupling part 32 which is bent upward from the plate-shaped part 31 of the intermediate lid 30, the dimension of a gap defined between the plate-shaped part 31 and an upper neighboring container body 20 is determined. In case that the gap is narrow, the intermediate lid 30 executes only a role of preventing the contact between neighboring container bodies 20, thus preventing contained foods in the lower-layered container body 20 from being smeared on the upper-layered container body 20. On the other hand, in case that the gap is wide, that is, in case that the height of the part of the coupling part 32 which is bent upward from the plate-shaped part 31 is increased, a substantial space is defined between the intermediate lid 30 and the bottom of the upper-layered container body 20. Thus, foods may be contained in this substantial gap. In other words, additional storage space may be created by the intermediate lid 30. By providing various intermediate lids 30 each having a different storage capacity, the multi-layered container can be efficiently adapted according to various amounts of foods. As such, the multi-layered container of the present invention is more convenient to the user.

The operation of the multi-layered container according to the first embodiment of the present invention will be described herein below.

Figure 5:
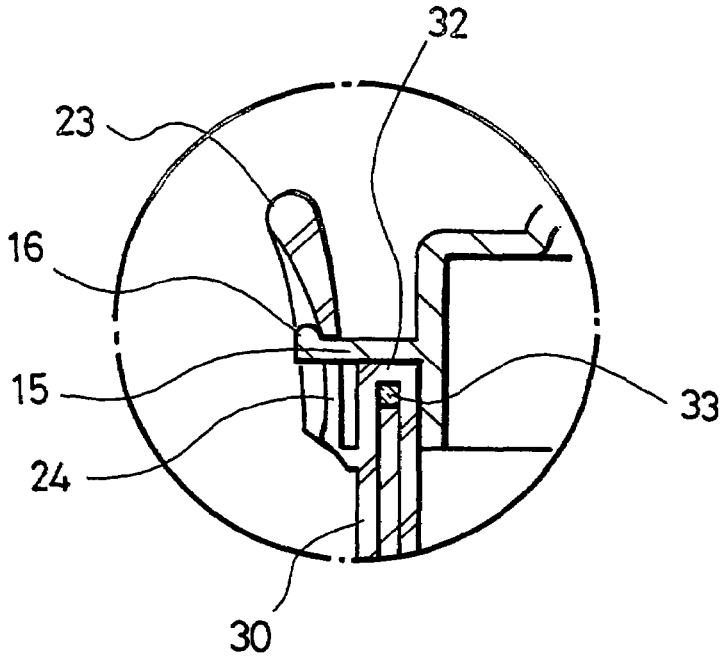
FIG. 5 is partially enlarged sectional view of an encircled portion "A" of FIG. 3.
Figure 6:
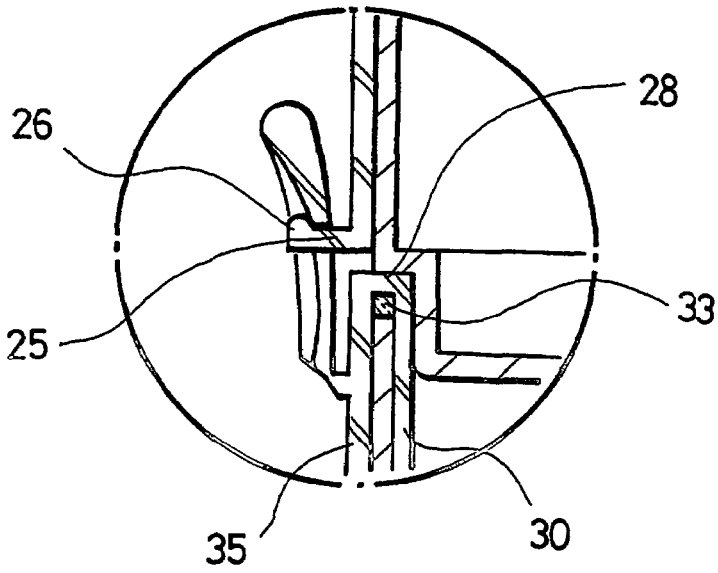
FIG. 6 is partially enlarged sectional view of an encircled portion "B" of FIG. 3.

First, foods are contained in each of the container bodies 20. Each of the intermediate lids 30 is, thereafter, coupled to each of the container bodies 20. At this time, in case that the gap defined between each of the intermediate lids 30 and each of upper neighboring container bodies 20 is wide, the foods may be contained in the intermediate lid 30. To couple each of the intermediate lids 30 to each of the container bodies 20, each of the coupling flanges 35 of the intermediate lids 30 slides along each of the guide rails 13 of the container body 20 after passing through the locking hole 24 of each of the locking flaps 23 of the container body 20. Therefore, each of the coupling flanges 35 is in close contact with the sidewall part-22 of the container body 20, thus preventing the coupling flange 35 from being undesirably moved. While each of the intermediate lids 30 is coupled to each of the container bodies 20, the gap defined between the intermediate lid 30 and the container body 20 is sealed by the packing 33 of each of the intermediate lids 30. Thereafter, the container bodies 20 covered with the intermediate lids 30 are sequentially stacked on top of another. The uppermost container body 20 is, thereafter, covered with the cover 10. In the above state, each of the locking flaps 23 of the uppermost container body 20 is rotated and compressed toward the cover 10, so that each of the first locking projections 15 of the cover 10 is elastically locked to the locking hole 24 of each of the locking flaps 23 of the uppermost container body 20, as shown in FIG. 5. Furthermore, each of the locking flaps 23 of each of the container bodies 20 is rotated and pressed toward each of the upper container bodies 20 so that, as shown in FIG. 6, the second locking projection 25 of each of the coupling flanges 35 of each of the intermediate lids 30 is elastically locked to each of the locking flaps 23.

As described above, in the present invention, by use of the intermediate lids 30, the outer surface of the bottom of each of the container bodies 20 is not smeared with the contained foods. Furthermore, even though the outer surface of the bottom of the upper-layered container body 20 is smeared with dust while the upper-layered container body 20 is placed on a surface on which the dust was deposited, the lower-placed intermediate lid 30 prevents the foods contained in the lower-layered container body 20 from being soiled with the dust smeared on the upper-layered container body 20. In case that the foods are contained in the intermediate lid 30, the coupling flanges 35 of the intermediate lid 30 serve as legs. By the coupling flanges 35, a bottom of the intermediate lid 30 is spaced apart from the surface on which the dust is deposited, while the intermediate lid 30 is placed on the surface. Thus, the dust is prevented from being smeared on the outer surface of the bottom of the intermediate lid 30. As such, the multi-layered container of the present invention can sanitarily store the foods therein.

In the meantime, because each of the coupling flanges 35 of each of the intermediate lids 30 has the second locking projection 25, existing container bodies can be stacked by using the intermediate lids 30. Therefore, a user obtains a desired multi-layered container by purchasing only the intermediate lids 30, thus reducing household expenses. Furthermore, none of the container bodies 20 has any locking projection, such as the first and second locking projections, so that a process of washing the container bodies 20 is simplified. In addition, during the process of washing the container bodies 20, a hand of the user or a scrubber is prevented from being damaged by the locking projection.

A multi-layered container according to a second embodiment of the present invention is as follows.

In the multi-layered container according to the second embodiment, each of locking projections of an intermediate lid and each of locking projections of an upper-layered container body are locked to the same locking flap, thus enhancing coupling and contact forces between the intermediate lid and the container body and between the intermediate lid and another neighboring container body.

Hereinafter, a construction of the multi-layered container of the present invention will be described in detail with reference to the attached drawings. The multi-layered container having a circular cross-section will be explained in the following description for the second embodiment of the present invention, but the bounds of claims of the present invention are not limited to the container having a circular cross-section.

Figure 7:
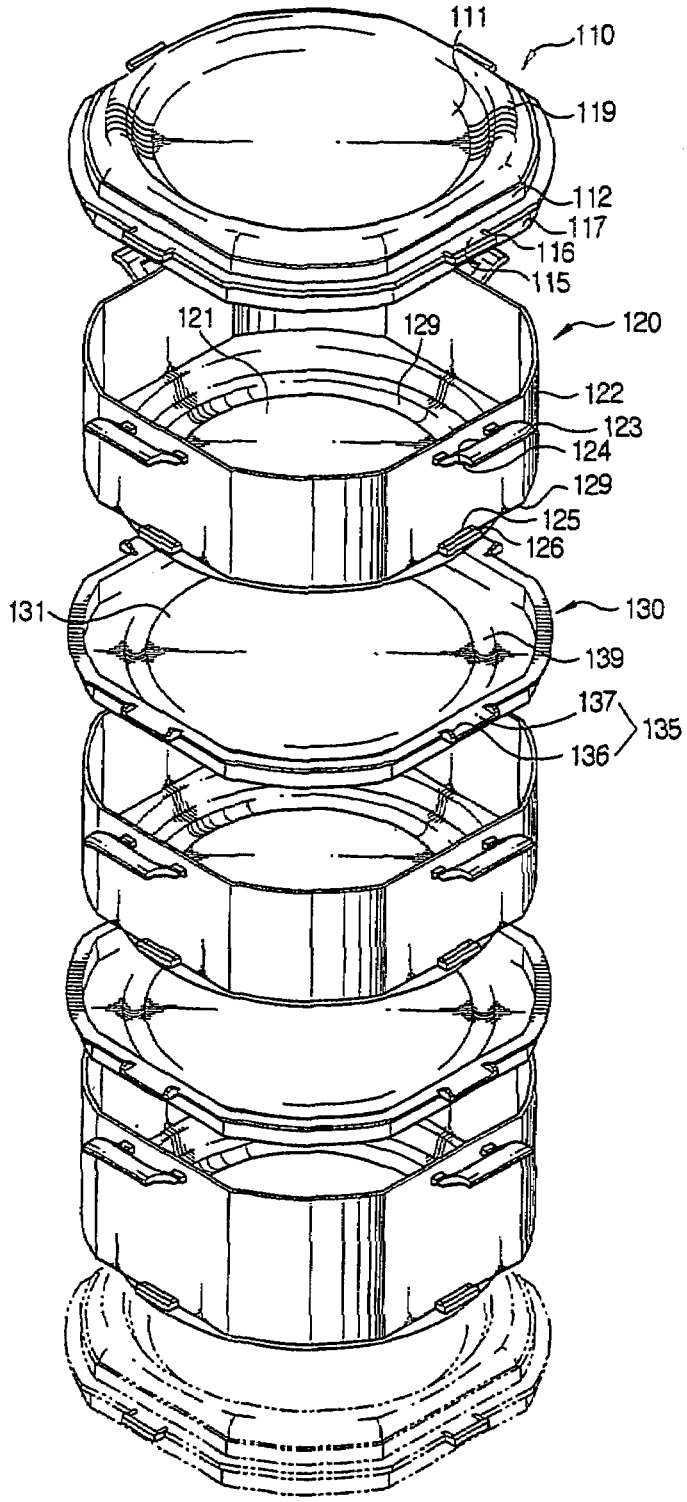
FIG. 7 is an exploded perspective view of a multi-layered container with an intermediate lid, according to another embodiment of the present invention.
Figure 8:
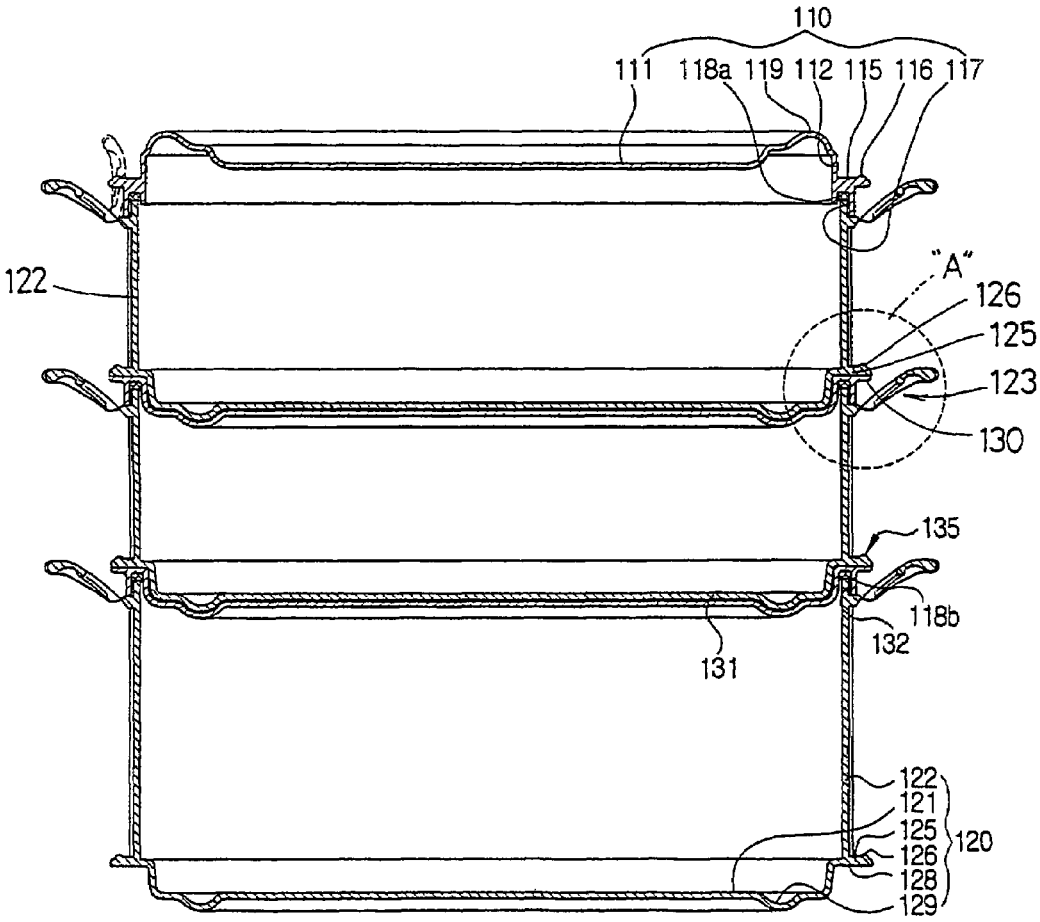
FIG. 8 is a sectional view of the assembled multi-layered container of FIG. 7.

As shown in FIGS. 7 and 8, the multi-layered container according to the second embodiment includes a cover 110, a plurality of container bodies 120 and a plurality of intermediate lids 130.

The cover 110 defines a nearly circular appearance. The cover 110 has a locking region which is provided on each of diametrically opposite parts of an outer surface of the cover 110, based on a central portion of the cover 110, to mount a locking device to the locking region. The cover 110 may have a pair of or more opposite locking regions. The cover 10 includes a cover plate part 111 to cover an uppermost container body 120. The cover 110 further includes a sidewall part 112 which extends downward from the cover plate part 111, with a first locking projection 115 provided at each of the locking regions around an outer surface of the sidewall part 112 to be projected outward from the outer surface of the sidewall part 112.

Each of the first locking projections 115 has a first locking protrusion 116 which is protruded upward from an end of each of the first locking projections 115, thus being locked to a locking hole 124 of each of locking flaps 123 which will be described later herein. By each of the locking protrusions 116, each of the locking flaps 123 is elastically locked to and unlocked from each of the first locking projections 115.

Figure 9A:
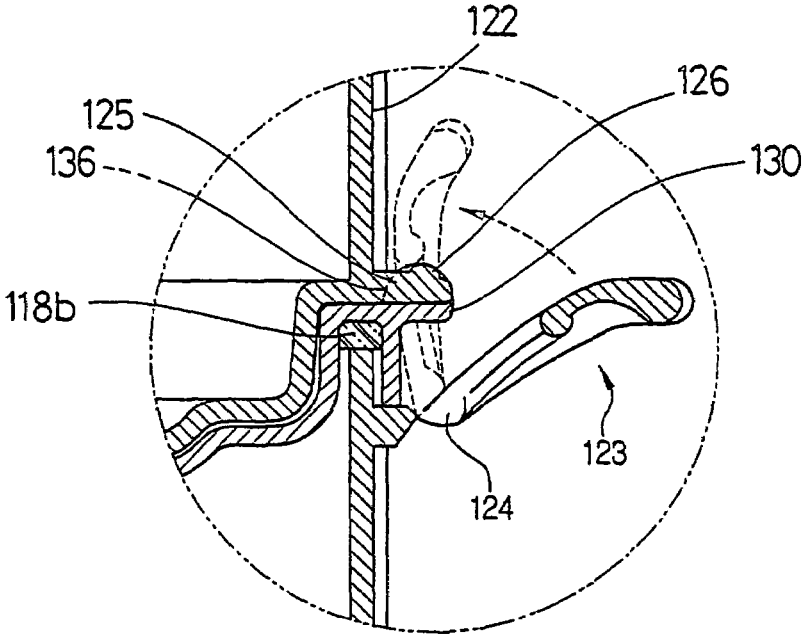
FIGS. 9A and 9B are enlarged perspective views showing second and third locking projections of the multi-layered container of FIG. 7.
Figure 9B:
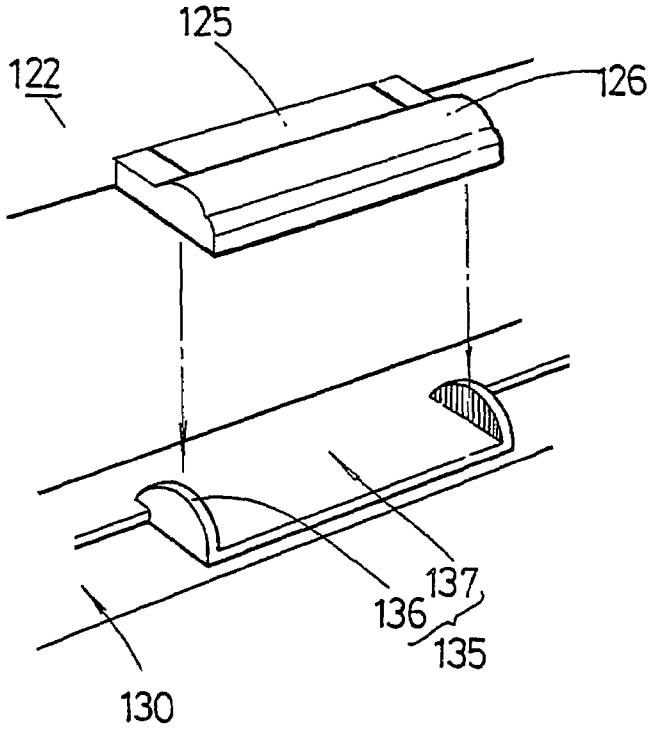
Figure 10:
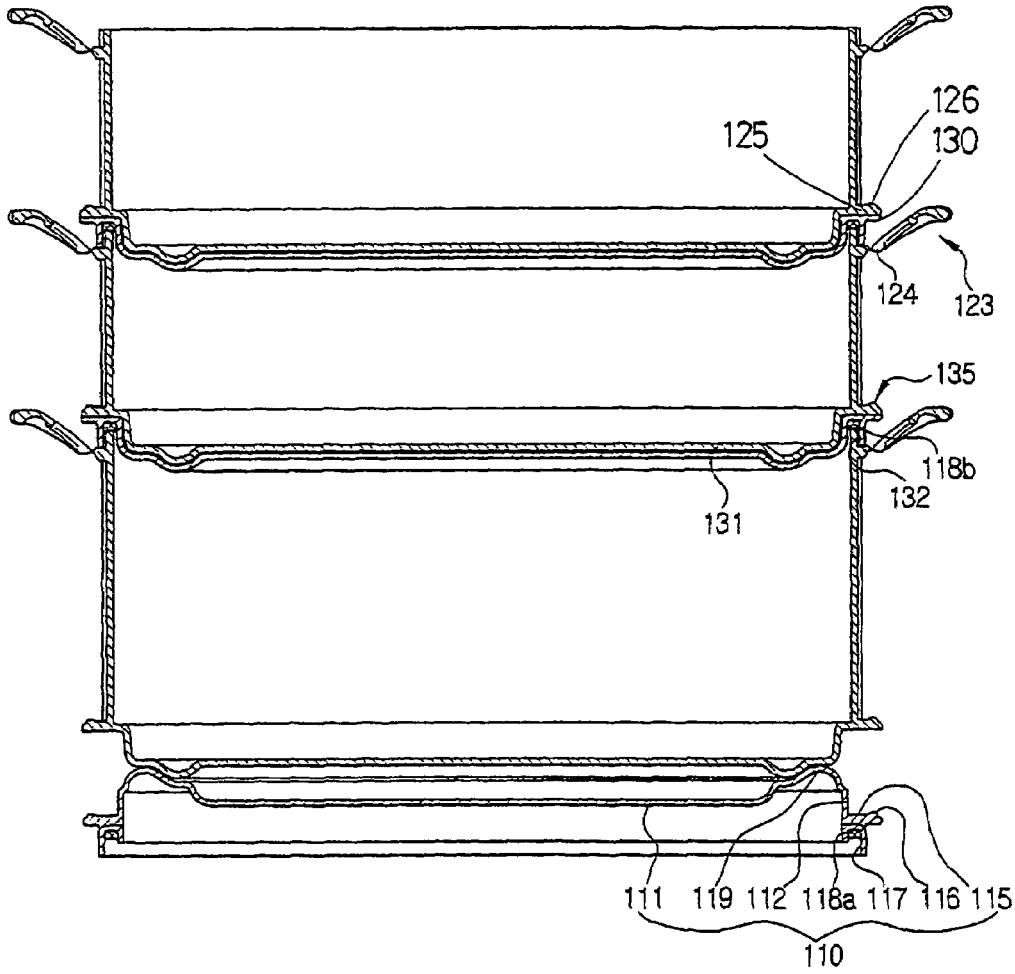
FIG. 10 is a sectional view illustrating an operation of the multi-layered container of FIG. 7.

In the meantime, as shown in FIGS. 9, 9A and 10, the cover 110 has a receiving groove 117 which has a channel-shape to be opened downward and is seated on an edge of an open end of the uppermost container body 120. A packing 118*a* is provided in the receiving groove 117 to seal a space defined between the uppermost container body 120 and the cover 110.

Each of the container bodies 120, which has a structure which makes it possible to be covered with the cover 110, includes a plurality of locking regions which define plate-shaped appearances and correspond to the locking regions of the cover 110. Each of the container bodies 120 has a circular-shaped appearance. Each of the container bodies 120 comprises a bottom part 121 having a circular appearance, and a sidewall part 122 extending upward from an edge of the bottom part 121. Each of the container bodies 20 further comprises a seating rib (not shown) which is provided around a predetermined portion of an outer surface of the sidewall part 122 near to an open top of the container body 120 to be projected outward in a circumferential direction of the sidewall part 122. Thus, the sidewall part 112 of the cover 110 is seated on the seating rib of the container body 120. A stepped part 128 is provided along a lower portion of the sidewall part 112 of each of the container bodies 20 near to the bottom part 121 while being depressed from the sidewall part 122 to the bottom part 121, thus being stepped inward from the sidewall part 122. The stepped part 128 of the container body 120 is seated on an edge of an open top of another container body 120, thus obtaining multi-layered container bodies 120.

The locking flap 123 and a second locking projection 25 are provided on each of the locking regions of each of the container bodies 120, so that the locking flaps 123 are locked to the first locking projections 115 of the cover 110 or the second locking projections 125 of another container body 120. Each of the second locking projections 125 is provided just above the stepped part 128 of each of the container bodies 120. Each of the second locking projections 125 has a second locking protrusion 126 which is protruded upward from an end of each of the second locking projections 125, in the same manner as that described for the first locking projections 115.

Each of the locking flaps 123 is projected outward from the outer surface of the sidewall part 122 of the container body 120 to be aligned with the seating rib of the container body 120. Furthermore, each of the locking flaps 123 is rotated around a film hinge which is provided on each of predetermined portions extending from the seating rib. Each of the locking flaps 123 has thereon a locking hole 124 to lock the locking flap 123 to each of the first or second locking projections 115 or 125. Each of the locking holes 24 extends to the outer surface of the sidewall part 22 of the container body 20.

In the meantime, the cover 110 and each of the container bodies 120 have structures which make it possible to seat the container body 120 on the cover 110 which is separated from the uppermost container body 120. That is, each of the container bodies 120 has a projection ring 129 which has a predetermined width and is projected downward from an outer surface of the bottom part 121 of the container body 120 to form a support ring on the bottom part 121. The cover 110 has a first seating ring 119 which has a predetermined radius to correspond to an inner diameter or an outer diameter of the projection ring 129 of the container body 120 and is projected upward from an outer surface of the cover plate part 111 of the cover 110 to form a support ring on the cover 110. To seat the container bodies 120 on the cover 110, the cover 110 is placed on a support surface. Thereafter, as shown in FIG. 4, the container bodies 120 are sequentially seated on the cover 110 while the first seating ring 119 of the cover 110 is in close contact with the projection ring 129 of a lowermost container body 120. At this time, by a correspondence between the first seating ring 119 and the projection ring 129, the container bodies 120 are prevented from being undesirably moved on the cover 110. A plurality of intermediate lids 130, which will be described later herein, each have a second seating ring 139 which is depressed from the intermediate lid 130 to seat the projection ring 129 of an upper-layered container body 120 on the second seating ring 139.

In the multi-layered container according to the second embodiment, the plurality of intermediate lids 30 are respectively provided between the cover 110 and an uppermost container body 120 and between the container bodies 120. Each of the intermediate lids 130 has a plate-shaped part 131 to prevent contact between neighboring two-layered container bodies 120, and a sidewall part which has a coupling slot 132 into which the edge of the open top of the container body 120 is inserted. The plate-shaped part 131 is arranged to be parallel with both the cover 110 and the container body 120. The coupling slot 132 is bent into a channel shape while extending upward, outward and downward from an edge of the plate-shaped part 131. The multi-layered container further includes a packing 133 which is provided in the coupling slot 132 of each of the intermediate lids 130, thus sealing a space defined between the edge of the open top of the container body 120 and the intermediate lid 130.

In the meantime, each of the intermediate lids 130 further has a third locking projection 135 which is provided on each of predetermined portions of the sidewall part of the intermediate lid 130 to correspond to both each of the second locking projections 125 of each of the container bodies 120 and each of the locking flaps 123 of another container body 120, while the third locking projection 135 extends outward from the sidewall part. Each of the third locking projections 135 comprises a projection seat 137 which is depressed in a circumferential direction of the intermediate lid 130 to receive therein each of the second locking projections 125. Each of the third locking projections 135 further comprises a support projection part 136 which is provided on each of both ends of the projection seat 137 to be projected to a height equal to a thickness of each of the second locking projections 125, thus being locked to the locking flap 123. At this time, each of the support projection parts 136 has the same shape and the same height as each of the second locking projections 125. Thus, during a locking flap coupling process, each of the second locking projections 125 and each of the third locking projections 135 corresponding to each other are integrally locked to the same locking flap 123.

The operation of the multi-layered container according to the second embodiment of the present invention will be described herein below.

First, foods are contained in each of the container bodies 120 and each of the intermediate lids 130 which has a sufficient depth to contain the foods therein. Each of the intermediate lids 130 is, thereafter, coupled to each of the container bodies 120. At this time, the packing 118*b* of each of the intermediate lids 130 is in close contact with the edge of the open top of each of the container bodies 120. Thereafter, the container bodies 120 covered with the intermediate lids 130 are sequentially stacked on top of another. The uppermost container body 20 is, thereafter, covered with the cover 10. Then, each of the second locking projections 125 of each of the upper-placed container bodies 120 is received in the projection seat 137 of each of the third locking projections 135 of the lower-placed intermediate lids 130. Furthermore, the edge of the open top of each of the container bodies 120 is inserted into each of the coupling slots 132, thus being in close contact with each of the packings 118*b*. Thereafter, the cover 110 is seated on the uppermost container body 120. Therefore, the edge of the open top of the uppermost container body 120 is inserted into the receiving groove 117 of the cover, thus being in close contact with the packing 118*a*. In the above state, each of the locking flaps 123 of the uppermost container body 120 is rotated and compressed toward the cover 110, so that each of the first locking projections 115 of the cover 110 is elastically locked to the locking hole 124 of each of the locking flaps 123 of the uppermost container body 120. Furthermore, each of the locking flaps 123 of each of the container bodies 120 is rotated and pressed toward each of the upper-layered container bodies 120, so that each of the third locking projections 135 and each of the second locking projections 125, received in the projection seat 137 of each of the third locking projections 135, are elastically locked to each of the locking flaps 123. At this time, the packing 118*a* of the cover 110 and the packings 118*b* of the intermediate lids 130 are in close contact with the edges of the open tops of the container bodies 120, respectively.

In the second embodiment using the intermediate lids 130 having the above-mentioned coupling structure, each of the intermediate lids 130 is in close contact with each of the upper-layered container bodies 120 by each of the locking flaps 123. Therefore, the coupling between each of the intermediate lids 130 and each of the neighboring container bodies 120 is enhanced. Simultaneously, the coupling and contact between each of the intermediate lids 130 and each of the relevant container bodies 120 is enhanced, thus obtaining the effect of sealing the multi-layered container.

Furthermore, the outer surface of the bottom of each of the container bodies 120 is not smeared with the contained foods. In addition, even though the outer surface of the bottom of the upper-layered container body 120 is smeared with dust while the upper-layered container body 120 is placed on a surface on which dust is deposited, the lower-placed intermediate lid 130 prevents the foods contained in the lower-layered container body 120 from being soiled with the dust smeared on the upper-layered container body 120.

INDUSTRIAL APPLICABILITY

As described above, the present invention provides a multi-layered container, which has an intermediate lid with a structure possible to sanitarily contain foods in the container and allowing even existing container bodies to be stacked into a multi-layered container.

Furthermore, the multi-layered container of the present invention increases the coupling force between the intermediate lid and a neighboring container body and the coupling and contact forces between the intermediate lid and a relevant container body, thus preventing the contained foods from undesirably leaking out.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A multi-layered container, comprising, a cover, with a plurality of first locking projections provided around a circumferential outer surface of the cover at predetermined intervals to be projected outward from the outer surface of the cover;

a plurality of container bodies, comprising a plurality of locking flaps provided around a circumferential outer surface of each of the plurality of container bodies at predetermined intervals to correspond to the first locking projections of the cover, each of the plurality of locking flaps rotatably extending from each of predetermined portions of the circumferential outer surface of the container body near to an open top of the container body, with a locking hole provided on the locking flap to lock the locking flap to each of the first locking projections; and an intermediate lid provided between the cover and an uppermost container body or between the container bodies, the intermediate lid comprising:

a plate-shaped part;

a coupling part bent into a channel-shape while extending from an edge of the plate-shaped part, the coupling part seated on an edge of the open top of each of the container bodies; and a plurality of coupling flanges extending downward from predetermined portions of the coupling part to be placed around the circumferential outer surface of the container body at predetermined intervals, with a second locking projection provided on an end of each of the plurality of coupling flanges to be locked to each of the locking flaps of a neighboring container body, and further comprising:

a guide rail having a pair of guide projections projected from predetermined portions of the outer surface of each of the container bodies to correspond to each of the coupling flanges of the intermediate lid, so that each of the coupling flanges slides downward along the guide rail on the outer surface of the container body while the intermediate lid is coupled to the container body.

2. The multi-layered container according to claim 1, wherein each of the coupling flanges comprises an inclined surface at each of both sidewalls thereof such that an inner surface of the coupling flange which is in contact with the container body is wider and an outer surface of the coupling flange is narrower, and each of the guide projections of the guide rail is enlarged in a width as the guide projection is projected from the outer surface of the container body so that a contact surface of each of the guide projections which is in contact with each of the sidewalls of the coupling flange is inclined to correspond to the inclined surface of each of the sidewalls of the coupling flange.

3. The multi-layered container according to claim 1, further comprising:

a packing provided in the coupling part of the intermediate lid to be in close contact with the edge of the open top of the container body.

4. A multi-layered container, comprising: a cover, with a plurality of first locking projections provided around a circumferential outer surface of the cover at predetermined intervals to be projected outward from the outer surface of the cover; and a plurality of container bodies, comprising: a plurality of locking flaps extending from each of predetermined portions of a circumferential outer surface of the container body near to an open top of each of the container bodies to correspond to each of the first locking projections, each of the locking flaps rotated between a position of locking the cover to the container body and a position of unlocking the cover from the container body, with a locking hole provided on the locking flap to lock the locking flap to each of the first locking projections; and a plurality of second locking projections provided around the circumferential outer surface of each of the container bodies at predetermined intervals while being projected outward from predetermined portions near to a bottom of the container body to be parallel with the locking flaps so that the second locking projections are locked to the locking flaps another container body, wherein the multi-layered container further comprising:

an intermediate lid provided between the container bodies, the intermediate lid comprising:

a plate-shaped part;

a coupling slot part bent into a channel shape to be opened toward a lower direction while extending from an edge of the plate-shaped part, the coupling slot part seated on an edge of the open top of each of the container bodies; and a third locking projection projected outward from each of predetermined portions of the coupling slot part to correspond to each of the second locking projections of each of the container bodies, so that the second and third locking projections corresponding to each other are locked to the same locking flap, wherein the third locking projection comprises:

a projection seat depressed in a circumferential direction of the intermediate lid to receive therein each of the second locking projections; and a support projection part provided on each of both ends of the projection seat to be projected to a height equal to a thickness of each of the second locking projections, thus being locked to the locking flap.

5. The multi-layered container according to claim 4, further comprising:

a packing provided in the coupling slot part of the intermediate lid to be in close contact with the edge of the open top of the container body.

* * * * *